US005222345A

United States Patent [19]

Riley

[11] Patent Number: 5,222,345

[45] Date of Patent: Jun. 29, 1993

[54] PROTECTIVE COVERING FOR WINDOW SILLS AND FRAMES

[76] Inventor: Thomas J. Riley, 195 Kingsbury Ave., Bradford, Mass. 01835

[21] Appl. No.: 744,285

[22] Filed: Aug. 13, 1991

[51] Int. Cl.[5] ..... E04C 2/32

[52] U.S. Cl. ..... 52/801; 52/716.1; 52/717.01; 52/717.03; 52/718.01

[58] Field of Search ..... 52/716.1, 717.01, 718.01, 52/717.03, 717.04, 202, 801

[56] References Cited

U.S. PATENT DOCUMENTS

| | | | |
|---|---|---|---|
| 938,768 | 11/1909 | Kenny | 52/718.1 |
| 1,243,903 | 10/1917 | Vogt | 52/717.1 |
| 4,379,376 | 4/1983 | Adell | 52/717.03 |
| 4,800,699 | 1/1989 | Lang | 52/717.1 |

FOREIGN PATENT DOCUMENTS

| | | | |
|---|---|---|---|
| 0135437 | 11/1949 | Australia | 52/716 |
| 1185174 | 7/1959 | France | 52/716 |
| 0533366 | 9/1955 | Italy | 52/801 |
| 0692815 | 6/1953 | United Kingdom | 52/801 |

*Primary Examiner*—Carl D. Friedman

*Assistant Examiner*—Wynn Wood

*Attorney, Agent, or Firm*—Edward A. Gordon

[57] ABSTRACT

An overlay structure for protecting and covering of existing interior and exterior frame works such as windows and doors having a plurality of frame members including the sill of window frame members. The overlay structure includes a flexible elongated laminar member having an outer facing layer and an inner facing layer. The outer facing layer is provided with a generally planar outer surface and the inner facing layer is corrugated to provide a plurality of elongated parallel grooves and ridges. The corrugated inner facing layer operates to provide the overlay structure with elongated structural flexibility so as to be easily and readily bent and cut to conform to the structural configuration of a window frame member to be covered. Suitable fastening means for fastening the overlay structure to an existing frame member can, for example, be nails, screws, staples, adhesives and glue of combinations thereof. The inner and outer facing layers are preferably formed of a highly flexible plastic material and can be formed as a unitary structure or as two separate members which are sealed together.

15 Claims, 4 Drawing Sheets

PROTECTIVE COVERING FOR WINDOW SILLS AND FRAMES

BACKGROUND OF THE INVENTION

1. Field Of The Invention

The present invention relates to window frame construction, and more particularly, to an improved window frame overlay assembly structure for protecting and covering of existing interior and exterior window frame members, including particularly the existing interior window sills having a potentially dangerous coating thereon such as lead paint.

2. Description Of The Prior Art

Aluminum and vinyl sidings have become a popular substitute for the periodic or biennial painting of homes because of their ready cleanability and resistance to deterioration. Aluminum siding has become relatively expensive, and is inherently less resilient, hence more difficult to use in construction, thereby enhancing interest in vinyl structures which are also capable of permanent use.

Also, the significant increase in home heating expense attendant the "energy crisis" of recent years has sparked interest in methods for enhancing the thermal insulation of building structures, especially single family residences which are often poorly or inadequately insulated as originally constructed. Such interest has resulted, for example, in development of various insulated sidings adapted to be applied as siding units for frame installation. Such sidings are easily installed around and about doors and windows and constitutes a permanent improvement in building and home value. The vinyl siding itself is usually of substantial thickness and, although resilient, is of substantial rigidity to satisfactorily hold up under the long term usage to which it is subjected. While such sidings are generally easily installed on the exterior sides of buildings, the cladding or overlaying of window frame members is expensive and difficult to accomplish.

With the increasing consciousness of the desirability of older buildings and the heat loss caused by poorly insulated windows, a need has arisen for insulated replacement window components. As disclosed in U.S. Pat. No. 3,815,285, metal clad, wooden windows have long been considered highly desirable for their ease of maintenance, superior insulation, pleasing appearance and long life. Exterior cladding of all window components, including both the sash and trim, has been most preferred. To date, however, the cladding of the exterior trim or frame has not been satisfactorily accomplished, where the original exterior trim of a window is retained after replacement of the sash. Since repair of a window by replacement of only the sash is widely preferred, the satisfactory cladding of the existing exterior frame of a window has become widely desired.

U.S. Pat. No. 4,341,048 discloses a method and assembly for cladding an existing exterior window frame. As disclosed, frame expander receptors are fastened to the window frame head and frame members. The frame expanders are retained in receiving recesses of the receptors. Cladding portions of the expanders clad the frame members and cover the fasteners. A sill nose cover clads the sill.

An extremely serious problem with existing interior window frames and particularly interior window sills is the possible coating thereof with dangerous material such as lead paint. Many children between the ages of, for example, 18 months and three and a half years old are poisoned as a result of such paint coating. Many children standing in front of the interior frame of a coated window are mesmerized by the outside activities, colors, etc.. As a result, they begin to suck and gnaw on the inside window sill, in particular, with the result that a portion of the lead paint coating is swallowed by the child which results in poisoning of the child. To date, a protective covering of interior and exterior window frames including covering of only the interior window sill for protection against poison paint has not been satisfactorily accomplished.

U.S. Pat. Nos. 4,682,451 and 4,492,062 each disclose a window sill assembly for covering an existing window sill at the base of the window. While such assemblies afford protection, a less complicated assembly including simplicity of installation is still preferred.

While the prior art has provided improvement in the area intended, there still exists a great need for a new and improved overlay structure for covering and protecting of the existing interior and/or exterior trim or frame of a window.

Accordingly a principal desirable object of the present invention is to provide a new and improved structure for covering and protecting the existing trim or frame of a window including the sill.

Another desirable object of the invention is to provide an improved structure for covering an existing interior window sill which provides a plastic covering over painted wooden trim.

A still further desirable object of the present invention is to provide an improved plastic sheet structure for covering window frames having a format that can be easily formed to fit the profile of any shaped window frame or sill.

Another desirable object of the present invention is to provide an improved protective covering for all or portions of existing interior or exterior window frames and sills and which also compliments the architectural features of the building while providing simplicity of installation, ease of maintenance and long life.

Another desirable object of the present invention is to provide a protective covering for interior and exterior existing frame structures such as windows, doors and the like which is economically manufactured and easily employed.

These and other desirable objects of the invention will in part appear hereinafter and will in part become apparent after consideration of the specification with reference to the accompanying drawings and the claims.

SUMMARY OF THE INVENTION

The present invention provides for a new and improved overlay structure for protecting and covering of existing interior and exterior frame works such as windows and doors having a plurality of frame members including the sills of window frame members. The overlay structure comprises a highly flexible elongated laminar member having an outer facing layer and an inner facing layer. The outer facing layer is provided with a generally planar outer surface and the inner facing layer is corrugated to provide a plurality of elongated parallel grooves and ridges. The corrugated inner facing layer operates to provide the overlay structure with elongated structural flexibility so as to be easily manually bent and cut to conform to the structural configuration of a frame member to be covered. Suitable fastening means for fastening the overlay structure to an existing frame member can, for example, be nails, screws, staples, adhesives such as double backed adhesives, glue and combinations thereof. The inner and outer facing layers are preferably formed of a relatively thin highly flexible plastic material such as thermoplastic and can be formed as a unitary structure or as two separate members which are sealed together. Additionally, the outer facing layer can be provided with a decorative outer surface including selected colors. In an alternate embodiment the outer facing layer can also be corrugated.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENT(S)

Figure 1:
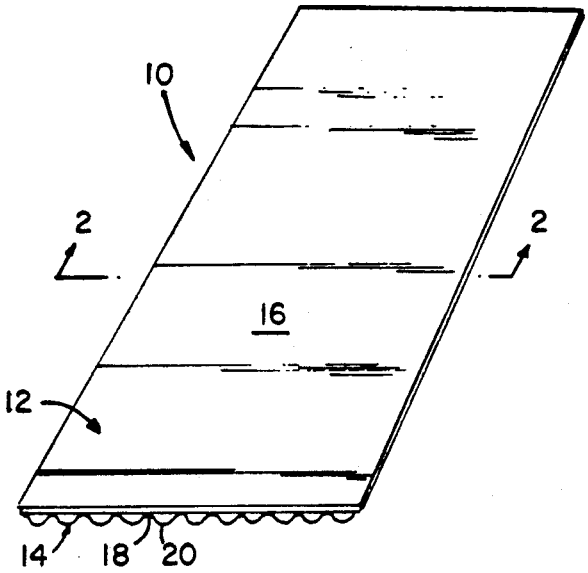
FIG. 1 is a perspective view of an overlay structure embodying the principles of the present invention.

Referring now to the drawings and more particularly to FIGS. 1-4, there is illustrated one embodiment of a flexible overlay structure, indicated generally by the numeral 10, embodying the principles of the present invention. It is to be understood that any reference in the specification and claims herein to frame members and sill members includes both interior and exterior structure. As illustrated, the overlay structure 10 comprises a flexible elongated laminar member having an outer facing unitary layer 12 and an inner facing unitary layer 14. The outer facing layer 12 is provided with a generally planar surface 16. It is to be understood that the present invention contemplates that the planar surface 16 can be contoured, textured, and colored to provide a design which is indicative of or enhances the design of the interior, such as the wall or wall paper or the exterior of the building, such as the shingles or clapboards adjacent to the frame to be overlaid. The inner facing layer 14 is corrugated to provide a plurality of elongated grooves 18 and ridges 20.

Figure 1A:
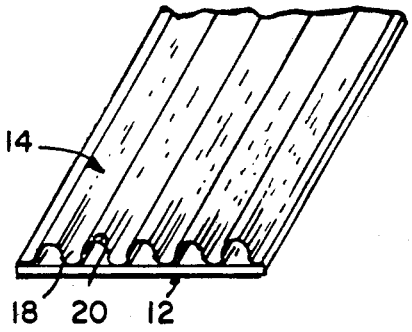
FIG. 1A is an enlarged fragmentary view of the reverse side of the structure of FIG. 1.
Figure 2:
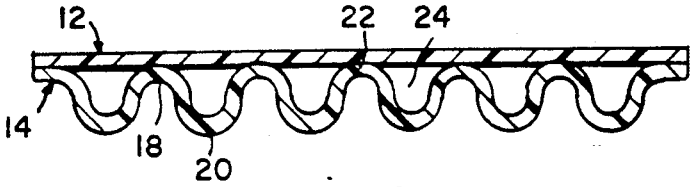
FIG. 2 is a cross-sectional view taken along the line 2—2 of FIG. 1.

The overlay structure 10 is preferably formed of plastic by molding techniques such as injection molding or extrusion molding. The outer facing layer 12 and the inner facing layer 14 can be formed by injection molding as separate members 12 and 14 as best seen in FIGS. 1A and 2. The separate members 12 and 14 can then be thermally sealed by conventional thermosetting techniques so that the areas of contact 22 between the grooves 18 and the outer facing layer 12 are sealed together to form a unitary overlay structure 10. It is to be understood that various conventional adhesives (not shown) can be used to attach the outer and inner facing members 12 and 14 together to from the overlay structure 10.

In addition to the flexibility of the plastic material used to form the overlay structure 10, the corrugated inner facing layer 14 operates to provide the overlay structure with elongated structural flexibility which enhances the elongated or lengthwise flexibility so that the overlay structure can be easily, readily and manually bent to conform to the structural configuration of a window frame member(s) to be covered. Additionally the corrugated ridges 20 serve to provide resiliency to the overlay structure while the grooves 18 and holes or bores 24, defined by the grooves 18 and the ridges 20, provide an insulating area. In an alternate embodiment, the ridges 20 can be formed as a solid integral section (not shown) without bores 24 and similar to the embodiment described hereinafter with respect to FIGS. 7-10.

Figure 3:
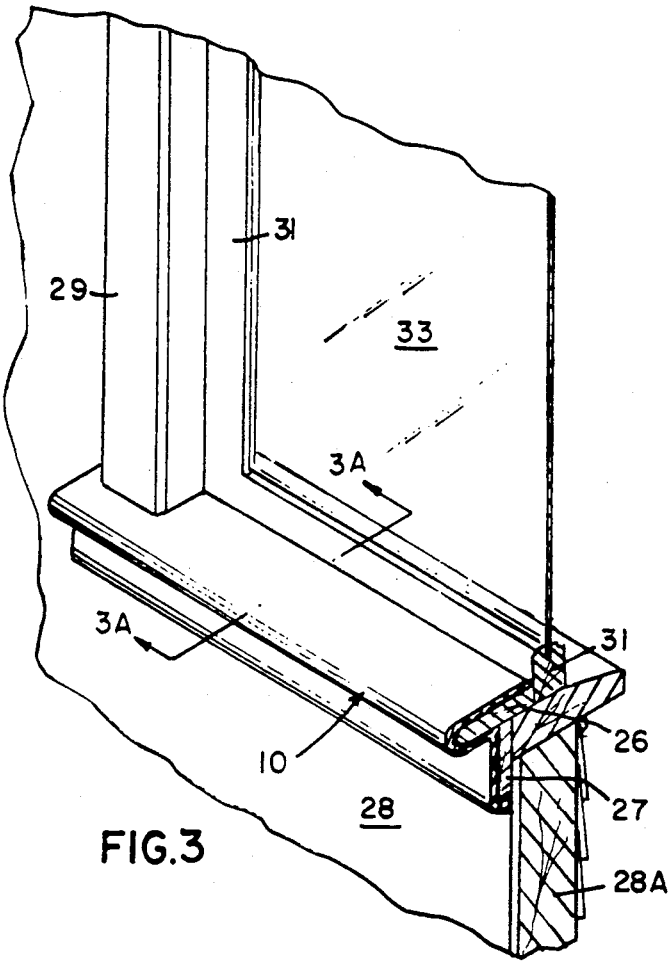
FIG. 3 is a fragmentary perspective view showing the manner in which the overlay structure of FIG. 1 is attached about an interior window sill and bottom frame portion according to the present invention.
Figure 3A:
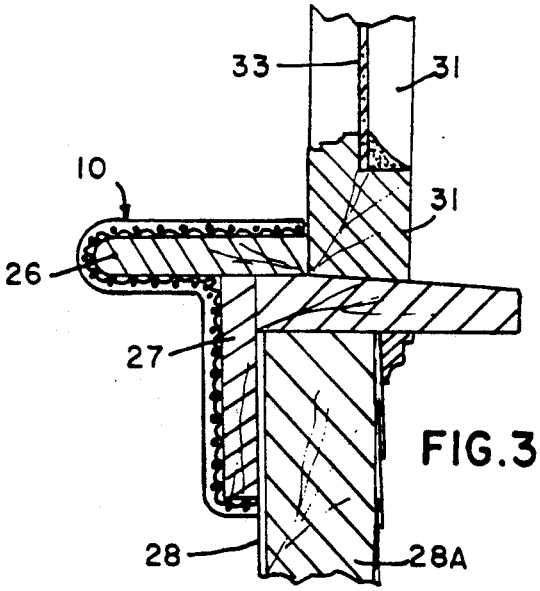
FIG. 3A is a cross-sectional view taken along the line 3A—3A of FIG. 3.

Referring now more particularly to FIGS. 3 and 3A, there is illustrated an embodiment of an overlay structure 10 mounted upon an interior window sill 26 and the lower frame member 27 attached to the inner surface 28 of the wall structure 28A. It is to be understood that the interior associated frame member(s) 29 can also be provided with an overlay structure 10 not shown in this embodiment. Also illustrated in this embodiment is a conventional window frame structure 31 enclosing a glass panel 33. The overlay structure can be attached to the inner surface of the window sill 26 and frame member 27 by suitable conventional attaching means such as nails, screws, staples and the like and suitable conventional adhesives, glue, mating VELCRO sections, and suitable combinations thereof as discussed further with respect to FIG. 4. As discussed herein, the overlay structure 10 serves as a protective device to shield access to the possible coating of the inner window sill with dangerous material such as lead paint. The overlay structure 10 can also serve in any instance as a decorative cladding.

Figure 4:
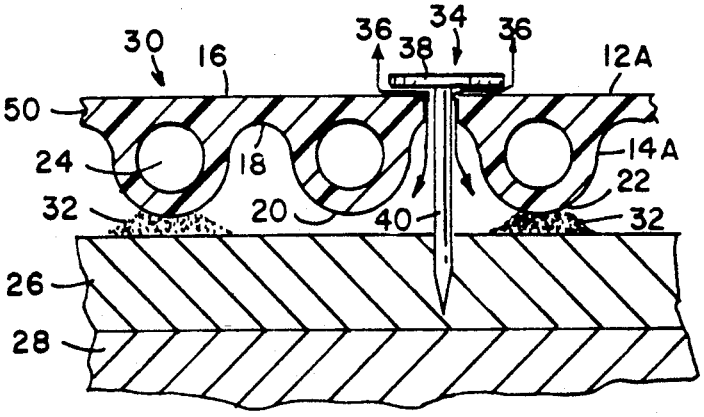
FIG. 4 is an enlarged fragmentary sectional view showing methods of attaching an overlay structure similar to that of FIG. 1 to a window frame member.

When desired, the overlay structure can be formed as a unified structure in a one step operation such as, for example, injection molding of the plastic material. In this manner the overlay structure 30 as depicted by FIG. 4 is formed as a unified structure having an outer facing layer portion 12A and an inner facing layer portion 14A similar to the overlay structure 10 of FIG. 1. In this embodiment the contact areas 22 of at least half of the corrugated ridges (by half it is meant alternate ridges) are attached to the inner window sill frame member 26 by an adhesive material 32 such as glue. In addition to or in place of the adhesive 32, attaching members such as nail member 34 can be employed. When a nail 34 is employed, the space shown by the arrows 36 between the head 38 and body 40 of the nail permits air to enter and exit as a result of ambient temperatures and pressures.

Figure 5:
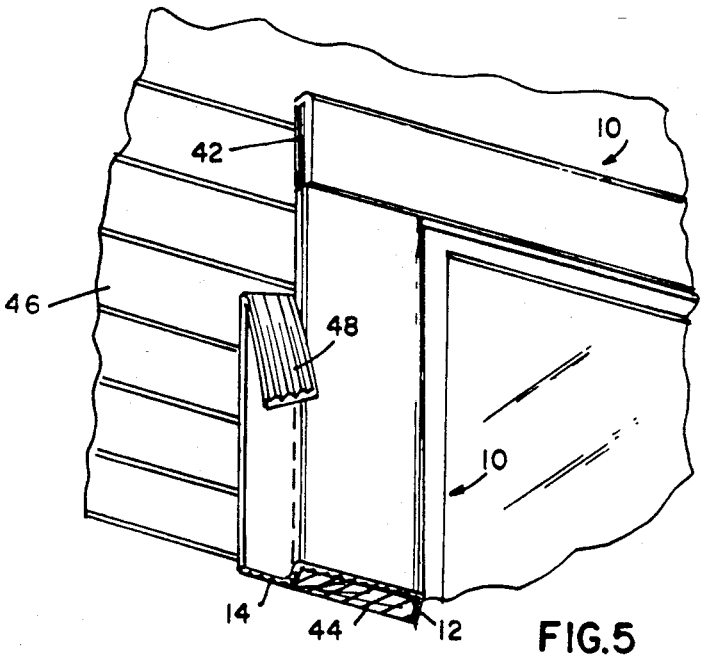
FIG. 5 is a fragmentary perspective view with partial sections showing the overlay structure of FIG. in the process of being mounted upon an existing window frame.

Referring now to FIG. 5, there is illustrated an overlay structure 10 of FIG. 1 in the process of being mounted upon existing exterior window frame members 42 and 44 which are surrounded by the exterior building clapboard members 46. In this illustration the inner facing layer 14 is coated with an adhesive (not shown) as discussed with respect to FIG. 4 and then bent about the frame members 42 and 44 sequentially. As shown with respect to frame member 44 the excess overlay structure section 48 is initially cut and the remaining section manually stripped to remove the excess section 48. It can be appreciated that the reduced distance 50 (FIG. 4) or thickness of the overlay structure 10 between the grooves 18 and the outer surface 16 permits the overlay structure 10 to be easily cut and manually removed so as to conform to the configuration of the frame structure to be covered.

Figure 6:
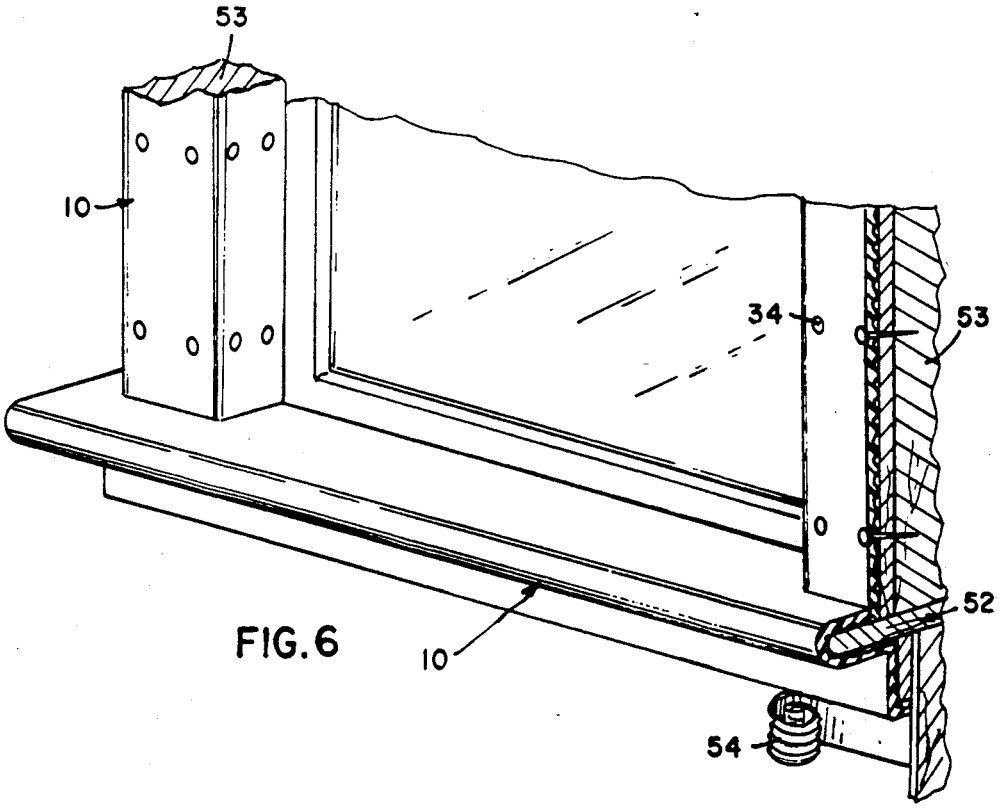
FIG. 6 is a fragmentary perspective view with partial sections showing the overlay structure of FIG. 1 mounted upon an existing window sill and associated frame members.
Figure 7:
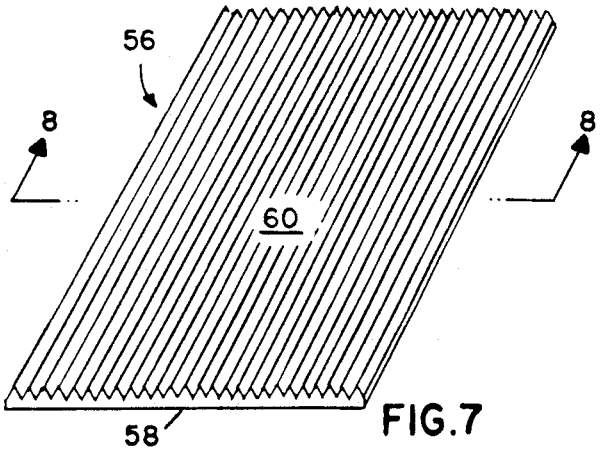
FIG. 7 is a perspective view of another embodiment of an overlay structure embodying the principles of the present invention.
Figure 8:
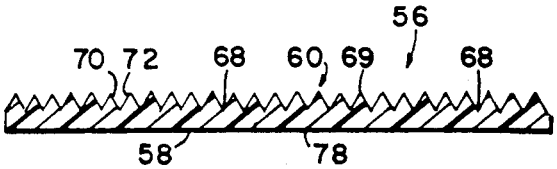
FIG. 8 is a cross-sectional view taken along the line 8—8 of FIG. 7.

Referring now to FIG. 6, there is illustrated an overlay structure 10 mounted upon a window sill 52 and associated frame members 53. In this example the overlay structure is attached to the frame members 53 by nails 34 while the overlay structure 10 covering the window sill member 52 is attached by adhesive not shown. Also, the excess strip 54 of the overlay structure 10 covering the window sill 52 is shown being removed in a manner similar to the strip 48 of FIG. 5.

Figure 9:
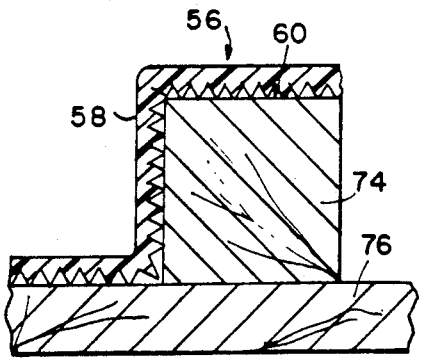
FIG. 9 is a fragmentary sectional view of the overlay structure of FIG. 7 attached to an existing frame structure.
Figure 10:
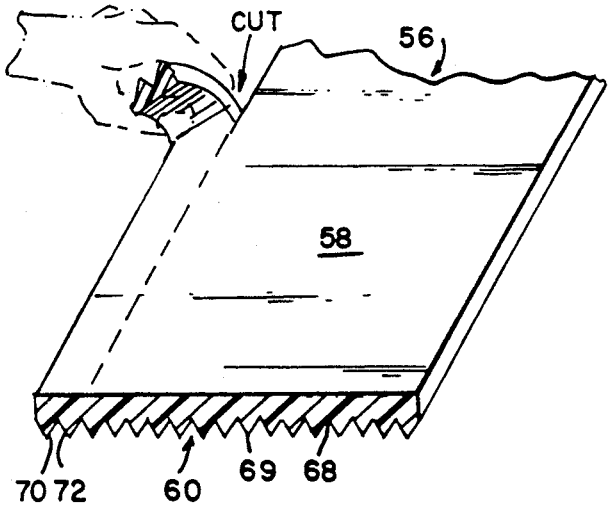
FIG. 10 is an enlarged perspective view of the overlay structure of FIG. 7 showing a method of removal of excess overlay structure.

Referring now more particularly to FIGS. 7-10 of the drawings, there is illustrated another embodiment of the present invention. In this embodiment the overlay structure illustrated generally by the reference numeral 56 comprises a uniform structure having an outer facing generally planar surface 58 and an inner facing surface 60 which is serrated to provide a plurality of V-shaped grooves 68 and ridges 69 defined by angularly spaced surfaces 70 and 72. FIG. 9 illustrates the overlay structure 56 partially mounted to the structure 74 (which represents either a frame or sill member) attached to the building structure 76 in the same manner as discussed with respect to FIGS. 3 and 3A. The serrated grooves 68 and ridges 69 provide for bending flexibility and resiliency similar to the overlay structure 10 of FIG. 1. Additionally the reduced thickness of the section 78 between the V-shaped groove 68 and the outer facing surface 58 provide for easy manual bending, cutting and stripping (as depicted in FIG. 10) of excess overlay structure 56 during the mounting process.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. An overlay structure for protecting and covering an existing frame structure, the overlay structure comprising:

a frame member;

an outer flexible elongated laminar member;

said outer flexible elongated laminar member having an outer facing layer and an inner facing layer;

said outer facing layer having a generally planar outer surface; and a corrugated inner facing layer member;

said corrugated inner facing layer member being formed to provide a plurality of elongated parallel grooves and ridges, whereby said corrugated inner facing layer operates to provide the laminar member with elongated structural flexibility so as to be easily and readily bent to conformity to the structural configuration of a frame member.

2. The overlay structure according to claim 1 further including fastening means for fastening said overlay structure to an existing frame structure.

3. The overlay structure according to claim 1 formed of a plastic material.

4. The overlay structure according to claim 1 wherein the outer facing layer member and the corrugated inner facing layer member are attached to each other.

5. The overlay structure according to claim 1 wherein the outer facing layer member and the corrugated inner facing layer member are formed as an integral structure.

6. The overlay structure according to claim 1 wherein the outer facing layer member is provided with a decorative outer surface.

7. The overlay structure according to claim 1 wherein the frame member is an interior window sill.

8. The overlay structure according to claim 1 wherein the frame members comprise an interior window frame.

9. The overlay structure according to claim 1 wherein the frame members comprise an exterior window frame.

10. The overlay structure according to claim 1 wherein the ridges of the corrugated inner facing layer member together with the outer facing layer member define openings therebetween.

11. An overlay structure for protecting and covering an existing exterior frame structure having a plurality of frame members, the overlay structure comprising:

a frame member;

an outer flexible elongated laminar member;

said outer flexible elongated laminar member having an outer facing layer and an inner facing layer;

said outer facing layer having a generally planar outer surface; and a corrugated inner facing layer member providing a plurality of elongated parallel grooves and ridges, whereby said corrugated inner facing layer member operates to provide the outer flexible laminar member with elongated structural flexibility so as to be easily and readily bent to conformity to the structural configuration of a frame member; and fastening means for fastening said overlay structure to the existing frame member.

12. The overlay structure according to claim 11 wherein the existing frame structure is a window frame including a window sill.

13. An overlay structure for protecting and covering an existing window sill, the overlay structure comprising:

a frame member;

an outer flexible cover structure;

said outer flexible cover structure having an outer facing layer and an inner facing layer;

said outer facing layer having a generally planar outer surface; and said inner facing layer member being formed to provide a plurality of elongated parallel grooves and ridges whereby said corrugated inner facing layer member operates to provide the laminar member with elongated structural flexibility so as to be easily and readily bent to conformity to the structural configuration of a window sill; and said cover structure being trimable so as to conform to the outer configuration of the window sill.

14. The overlay structure according to claim 13 further including fastening means for fastening said cover structure to an existing window sill.

15. The overlay structure according to claim 13 formed of a plastic material.

* * * * *